US005394177A

United States Patent [19]

McCann et al.

[11] Patent Number: 5,394,177

[45] Date of Patent: Feb. 28, 1995

[54] FOUR INCH FLUID SYSTEM

[75] Inventors: James D. McCann, Waynesville; Russell L. Bartley, Urbana; Randy D. Vandagriff, Dayton; Randal L. Mullins, Jamestown, all of Ohio

[73] Assignee: Scitex Digital Printing, Inc., Dayton, Ohio

[21] Appl. No.: 891,358

[22] Filed: May 29, 1992

[51] Int. Cl.[6] ..... B41J 2/17

[52] U.S. Cl. ..... 347/7; 347/17; 347/85

[58] Field of Search ..... 347/5–7, 347/17, 19, 84, 85

[56] References Cited

U.S. PATENT DOCUMENTS

| | | | |
|---|---|---|---|
| 3,761,953 | 9/1973 | Helgeson et al. | 347/7 |
| 4,591,870 | 5/1986 | Braun et al. . | |
| 4,623,897 | 11/1986 | Brown et al. . | |
| 4,628,329 | 12/1986 | Regnault | 347/7 |
| 4,651,161 | 3/1987 | Rich et al. | 347/6 |
| 4,864,323 | 9/1989 | Lecheheb et al. | 347/6 X |
| 5,241,189 | 8/1993 | Vandagriff et al. | 347/7 X |

*Primary Examiner*—Joan H. Pendegrass
*Attorney, Agent, or Firm*—Barbara Joan Haushalter

[57] ABSTRACT

A fluid system is usable with a four inch print head of a continuous ink jet printer. The fluid system controls all critical ink jet functions. The fluid functions electronically feedback-controlled by the fluid system include pressure control at the print head. The fluid system also controls ink temperature during startup and ink concentration. Finally, the fluid system controls vacuum level.

8 Claims, 2 Drawing Sheets

FOUR INCH FLUID SYSTEM

TECHNICAL FIELD

The present invention relates to continuous ink jet printers and, more particularly, to a fluid system for use with a four inch print head.

BACKGROUND ART

Ink jet printing systems are known in which a print head defines one or more rows of orifices which receive an electrically conductive recording fluid from a pressurized fluid supply manifold and eject the fluid in rows of parallel streams. Printers using such print heads accomplish graphic reproduction by selectively charging and deflecting the drops in each of the streams and depositing at least some of the drops on a print receiving medium, while others of the drops strike a drop catcher device.

As is obvious to those skilled in the art, the fluid system for a continuous ink jet printer must perform a number of functions. These functions include liquid supply, catch fluid return, startup and shutdown of the print head, and long-term storage. Known fluid systems typically provided electronic control for pressure at the print head, ink temperature during startup, or ink concentration. The control of these functions leads to improved long-term ink jet performance. There are various major components which accomplish these tasks. These components include a dc liquid pump, an ac vacuum pump, and various controls.

Existing ink jet printer systems, such as those described in U.S. Pat. Nos. 4,591,870 and 4,623,897 are much too small for some applications. They operate a print head with 60 jets, whereas it would be desirable to operate a print head with multiply more jets, such as 1024. It would also be desirable to have greater paper throughput in many applications.

It is seen then that there exists a need for a fluid system which can be used with a four inch print head.

SUMMARY OF THE INVENTION

This need is met by the system according to the present invention, wherein a fluid system for the four inch print head is a modular, computer controlled, portable unit. The fluid functions electronically feedback-controlled by the fluid system of the present invention include (1) pressure at the print head, (2) ink concentration, (3) vacuum level, and (4) ink temperature during startup.

In accordance with one aspect of the present invention, a fluid system for a four inch print head of a continuous ink jet printer having an ink pump, comprises: a means for controlling pressure at the print head; ink concentration sensor means; a vacuum control means for measuring a vacuum level of the fluid system; and ink temperature control means. The vacuum control means preferably comprises a vacuum transducer located in the fluid system for measuring vacuum level and a stepper motor attached to a conical valve for providing control.

Accordingly, it is an object of the present invention to provide a fluid system which can be used with a four inch print head. It is a feature of the present invention that the fluid system is a modular, computer controlled, portable unit, attachable to the print head by a flexible umbilical. It is a further advantage of the present invention to provide such a fluid system wherein the umbilical carries fluid to and from the print head, as well as electrical signals for controlling all print head functions.

Other objects and advantages of the invention will be apparent from the following description, the accompanying drawings and the appended claims.

DETAILED DESCRIPTION OF THE PREFERRED EMBODIMENTS

The present invention is a fluid system for a four inch print head which controls all critical ink-jet functions with a control means and appropriate electronics. The fluid functions electronically feedback-controlled by the fluid system of the present invention include (1) pressure at the print head, (2) ink concentration, (3) vacuum level, and (4) ink temperature during startup. Previously known fluid systems have provided electronic control for only one or two of these parameters, and never for vacuum level.

Figure 1:
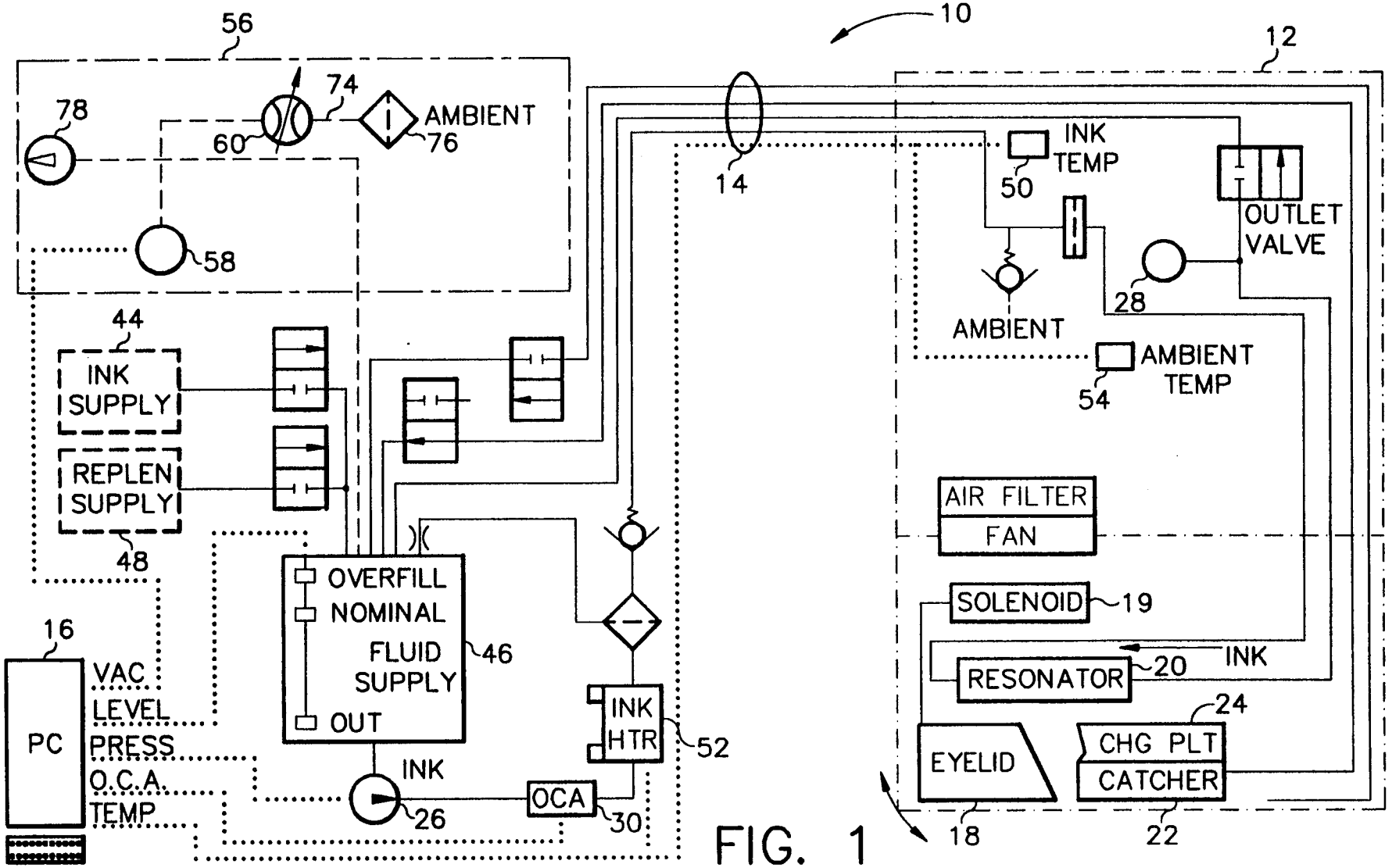
FIG. 1 is a schematic block diagram of a fluid system of the present invention.

Referring now to the drawings, in FIG. 1 a block diagram of a fluid system 10 of the present invention is illustrated. The fluid system 10 is particularly adaptable for use with a four inch print head 12 and is a modular, computer controlled, portable unit. The fluid system 10 is attached to the print head 12 by means of a flexible umbilical 14, preferably approximately 1.75 inches in diameter. The umbilical 14 connection carries fluid to and from the print head 12. The umbilical 14 also carries electrical signals to and from a control means 16, such as a computer, that controls the print head 12 functions.

The print head functions that are controlled include operation of a retractable catch pan or "eyelid" 18 for startup and shutdown. The eyelid 18, operated by a solenoid 19, seals the print head 12 so that ink from an orifice plate of a resonator 20 goes only to a catcher 22 during startup. The eyelid 18 also allows jets, once formed, to flow into the catcher 22 such that a charge plate 24 of the ink jet printer does not get wet. The print head 12 functions that are controlled also include proper fluid pressure, stimulation voltage, and charge voltage, as well as ink heating during startup, and catcher 22 and charge plate 24 heating to remove condensation at the catcher 22. Finally, the print head 12 communicates with the control means 16 during printing to control these functions. The print head 12 functions will be described in more detail below.

Continuing with FIG. 1, the fluid system 10 includes a pressure control means associated with the control means 16 to increase or decrease voltage to an ink pump 26. The pressure control means is necessary for printing, as well as other pressure levels during startup and shutdown. The pressure control means includes a pressure transducer 28 located at the print head 12 for providing the control means 16 with a voltage level, preferably between 0.5 and 4.5 volts, that corresponds to the actual ink pressure at the print head 12. A comparison means associated with the control means 16 then compares the actual ink pressure with a desired ink pressure and provides a comparison value. This comparison value is used by the computer 16 to adjust a pulse-width-modulated voltage to the ink pump 26 to attain the desired ink pressure. If the actual ink pressure is high or low in comparison to the desired ink pressure, then the computer 16 adjusts the pulse width modulated voltage to the ink pump 26 accordingly. This correction can occur almost continuously, on the order of up to forty times per second.

Figure 2:
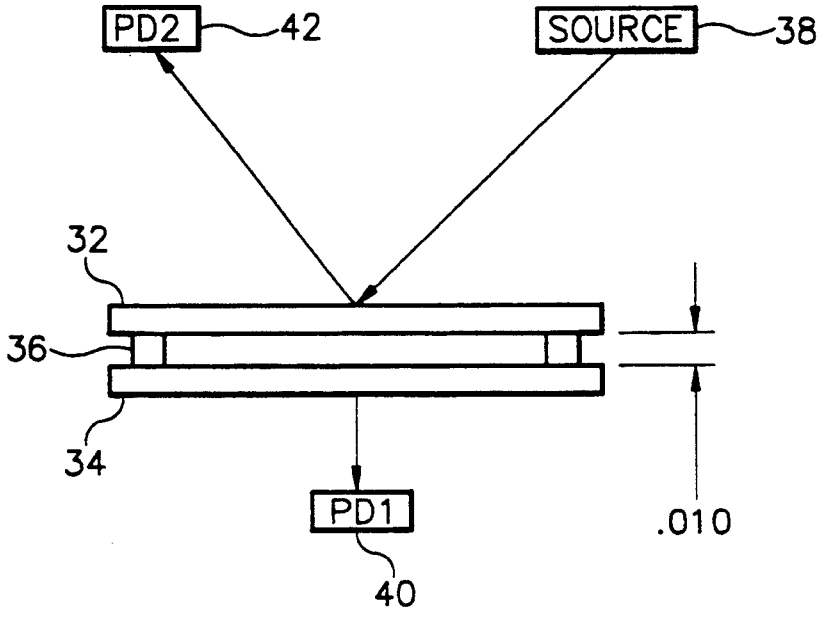
FIG. 2 is an ink concentration sensor means of the fluid system shown in FIG. 1.

Referring now to FIG. 2, the fluid system 10 also includes an optical concentration apparatus 30 of FIG. 1, for sensing ink concentration. The OCA 30 is comprised of a pair of transparent glass plates 32 and 34, separated a predetermined amount by a spacer means 36 to allow ink to pass between them. The spacer means spaces the plates 32 and 34 preferably at least 0.010 inches apart. A light source 38 is situated to direct a beam of light through the pair of transparent glass plates 32 and 34.

Continuing with FIG. 2, on the opposite side of the light source 38, a first photodiode 40 is responsive to incident light from the light source 38. A second photodiode 42, located on the same side of the plates 32 and 34 as the light source 38, receives reflected light from the light source 38 and provides a reference signal indicative of ink concentration. If the second photodiode 42 is receiving a low or high light level, a voltage to the light source 38 is adjusted accordingly. The first, or output, photodiode 40 measures the light that has passed through the glass slides 32 and 34, as well as the ink between the slides. If the first photodiode 40 measures a high light level, then the ink is too light. Then the next time the fluid system 10 fills with fluid, ink from an ink supply 44 will be added to a fluid supply 46 to provide the proper dye level. Alternatively, if the first photodiode 40 measures a low light level, then the ink is too dark. In this case, the next time the fluid system 10 fills with fluid, replenisher from a replenisher supply 48 will be added to the fluid supply 46, since replenisher contains little or no dye. Hence, the OCA 30 includes means for adjusting the ink concentration based on the light level received by the photodiodes 40 and 42.

Referring again to FIG. 1, the fluid system 10 includes ink temperature control means. The ink temperature control means comprises an ink temperature sensor 50, an ink heater 52 and an ambient temperature sensor 54 associated with the control means 16 for controlling ink temperature. The ink temperature control is provided mainly for the purpose of accomplishing the startup process required to startup the fluid system 10. The ink temperature control means comprises means for heating the ink sufficiently to place condensation on the charge plate 24 leads, preferably approximately 12 degrees Fahrenheit above ambient, in approximately ninety seconds. This washes any ink left from the startup procedure down to the catcher 22. Subsequent actuation of the catcher 22 and charge plate 24 heater and deactivation of the ink heater 52 evaporates this fluid. By the time the print head 12 is ready to print, the ink in the system 10 has returned to its nominal temperature level, typically a few degrees above ambient.

In a preferred embodiment of the present invention, the ink temperature may be controlled by a simple on-off control of the fluid heater 52 immersed in the ink. The ink temperature control means comprises the ink heater 52, which is a five hundred watt ink heater in the system 10, and thermistors at the heater 52, at the print head 12, and in the ambient environment. The information form the three thermistors is provided to the control means 16 so that if there is a problem either at the print head 12 or in the system 10, continuous heating of the ink can be avoided.

Figure 3:
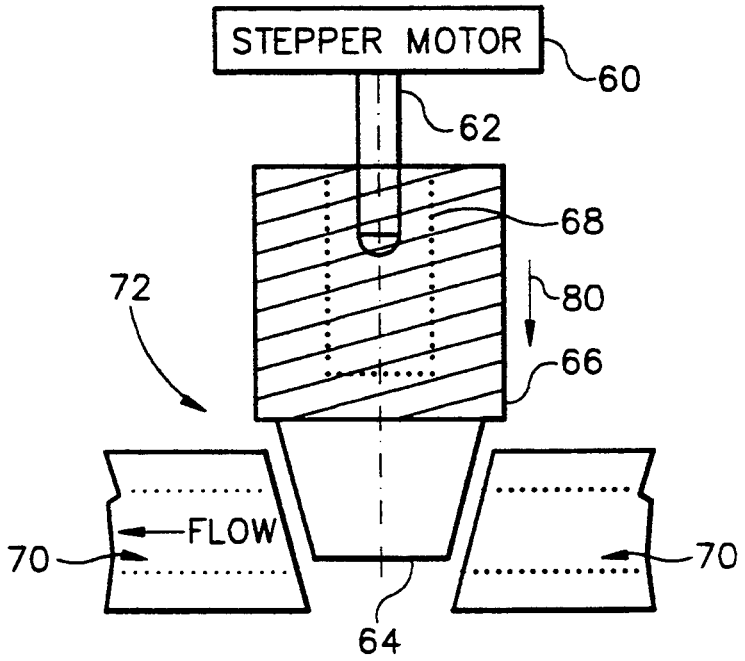
FIG. 3 is a block diagram of a vacuum level control fluid function electronically performed by the fluid system of FIG. 1.

The fluid system 10 also includes a novel vacuum control means 56 for controlling vacuum during startup, shutdown, and printing. Referring now to FIG. 3, a block diagram of the vacuum control means 56 shown in FIG. 1 is illustrated. A vacuum transducer 58 is located in the fluid system 10 which measures vacuum level. This information is provided to the control means 16 to control the vacuum. The vacuum control 56 is preferably provided by a stepper motor 60 having a shaft 62 and attached to a conical valve 64 via a threaded member 66 which includes a special adapter 68. When the stepper motor 60 turns the shaft 62, the shaft 62 causes the special adapter 68 to turn with the shaft 62, since the shaft 62 is attached to the special adapter 68. However, the special adapter 68 is placed in the threaded member 66, as shown in FIG. 3. Consequently, rotation of the motor 60 causes rotation of the special adapter 68. The special adapter 68 is placed in threaded member 66, thereby causing rotation and translation of the special adapter 68. This, in turn, causes translation of the conical valve 64.

Continuing with FIG. 3, since the conical valve 64 is attached to the special adapter 68, the valve 64 can also be moved back and forth along the axis of the shaft 62. This opens and closes an air passage 70 placed between the conical valve 64 and a larger conical opening in a vacuum control manifold 72 comprised of air passage 70, the large conical opening, and the threaded member 66. The conical valve 64 thus increases or decreases the flow into a secondary or bypass line 74 attached to an ambient air inlet 76 of a vacuum pump 78. This, in turn, changes the system 10 vacuum to the desired value. If a higher vacuum is desired, the conical valve 64 is pushed downward in the direction of arrow 80 to provide greater restriction. Conversely, if a lower vacuum is desired, the conical valve 64 is pushed upward opposite the direction of arrow 80 to provide less restriction.

The fluid system 10 controls all critical ink-jet functions with a computer and appropriate electronics. The fluid functions electronically feedback-controlled by the fluid system 10 of the present invention include (1) pressure at the print head with pressure control means, (2) ink concentration control with the OCA 30, (3) vacuum level with the vacuum control means 56, and (4) ink temperature during startup with ink temperature control means. Previously known fluid systems have provided electronic control for only one or two of these parameters, and have never provided electronic control for vacuum level.

Industrial Applicability and Advantages

The present invention is useful in the field of ink jet printing, and has the advantage of providing a fluid system for use with a four inch print head. The present invention provides the further advantage of having the capability of controlling all critical ink jet functions. Finally, the fluid system of the present invention provides the advantage of being attachable to the print head via a flexible umbilical which carries fluid to and from the print head, as well as electrical signals for controlling all print head functions.

Having described the invention in detail and by reference to the preferred embodiment thereof, it will be apparent that other modifications and variations are possible without departing from the scope of the invention defined in the appended claims.

What is claimed is:

1. A fluid system for a four inch print head of a continuous ink jet printer having an ink pump, comprising:

a. means for controlling pressure at the print head;

b. ink concentration sensor means;

c. a vacuum control means for measuring a vacuum level of the fluid system; and d. ink temperature control means.

2. A fluid system as claimed in claim 1 wherein the means for controlling pressure at the print head comprises:

a. a transducer located at the print head for providing a voltage level corresponding to actual ink pressure at the print head;

b. comparison means for comparing the actual ink pressure with a desired ink pressure and providing a comparison value; and c. means for adjusting a pulse-width-modulated voltage to the ink pump based on the comparison value.

3. A fluid system as claimed in claim 1 wherein the ink concentration sensor means comprises:

a. a pair of transparent glass plates;

b. spacer means for separating the pair of glass plates by a predetermined amount to allow ink to pass between them;

c. a light source for directing a beam of light through the pair of transparent glass plates;

d. a first photodiode responsive to incident light from the light source;

e. a second photodiode for receiving reflected light from the light source and providing a reference signal indicative of ink concentration; and f. means for adjusting the ink concentration based on the reference signal.

4. A fluid system as claimed in claim 1 wherein the vacuum control means comprises a vacuum transducer located in the fluid system for measuring vacuum level.

5. A fluid system as claimed in claim 4 wherein the vacuum control means further comprises a stepper motor attached to a conical valve for providing control.

6. A fluid system as claimed in claim 1 wherein the ink temperature control means comprises ink temperature control during startup of the print head.

7. A fluid system as claimed in claim 6 wherein the ink temperature control means comprises means for heating ink in the fluid system during startup of the print head.

8. A fluid system as claimed in claim 7 wherein the means for heating ink comprises a fluid heater immersed in the ink.

* * * * *